US005373876A

United States Patent [19]

Tähkänen et al.

[11] Patent Number: 5,373,876

[45] Date of Patent: Dec. 20, 1994

[54] CHIPPING CONTROL DEVICE AND DISC CHIPPER

[75] Inventors: Hannu Tähkänen, Rauma; Aaro Klaavu; Alpo Kalliokoski, both of Pori, all of Finland

[73] Assignee: Sunds Defibrator Woodhandling Oy, Pori, Finland

[21] Appl. No.: 137,744

[22] Filed: Oct. 19, 1993

[30] Foreign Application Priority Data

Oct. 19, 1992 [FI] Finland ..... 924734

[51] Int. Cl.[5] ..... B27C 1/14

[52] U.S. Cl. ..... 144/176; 144/162 R; 241/92; 241/278.1

[58] Field of Search ..... 241/28, 92, 274, 278.1, 241/296; 144/162 R, 172, 174, 176

[56] References Cited

U.S. PATENT DOCUMENTS

| | | | |
|---|---|---|---|
| 685,018 | 10/1901 | Unser | 241/92 |
| 2,172,449 | 9/1939 | Pelot et al. | 144/176 |
| 2,566,721 | 9/1951 | Dunbar | 241/92 |
| 3,346,027 | 10/1967 | Kirsten | 144/176 |
| 3,647,151 | 3/1972 | Artiano et al. . | |
| 3,661,329 | 5/1972 | Smith et al. . | |
| 4,247,053 | 1/1981 | Lapointe | 241/92 |
| 4,346,744 | 8/1982 | Beer et al. | 144/176 |
| 4,685,497 | 8/1987 | Mienau et al. | 241/92 |
| 5,139,063 | 8/1992 | Nettles et al. | 144/176 |

FOREIGN PATENT DOCUMENTS

| | | |
|---|---|---|
| 70171 | 7/1978 | Finland . |
| 79799 | 11/1989 | Finland . |
| 400211 | 3/1978 | Sweden . |

*Primary Examiner*—W. Donald Bray
*Attorney, Agent, or Firm*—Burns, Doane, Swecker & Mathis

[57] ABSTRACT

A chipping control device (9) to be mounted on a disc chipper and a disc chipper for keeping the piece size of the chips (8) removed from the wood (1) with a chipper blade (6) uniform. The chipping control device (9) is mounted on the outer surface of the blade disc (4) on the opposite side of the blade (6) such that the control device (9), when using the chipper, contacts the chips (7, 8) leaving the chipping opening (13).

20 Claims, 5 Drawing Sheets

CHIPPING CONTROL DEVICE AND DISC CHIPPER

The present invention relates to chipping control device to be mounted on a disc chipper for keeping the piece size of the chips removed from the wood with a chipper blade uniform. The invention also relates to disc chipper having a rotatable disc provided with longitudinal blades and on the disc a longitudinal opening adjacent each blade, via which opening the chips are removed.

By means of the inventive control device, it is possible to affect the making of pulp chips with disc chippers. Nowadays, almost all wood chips utilized in the paper industry is produced with disc chippers. A certain disc chipper is described in a Finnish patent publication FI 79799. The disc chipper has a disc rotating around a horizontal or tilted shaft and provided with blades, against which disc the woods are fed, as well as a stationary counterblade. The blades of the disc are approximately radially directed, and there is a wearing plate in a sector between each two blades. The pieces of chips cut from the wood leave via longitudinal openings adjacent the blades on the disc.

Since a uniform chips quality is decisive for a successfull further treatment, great efforts have now been made for improving the chips quality.

The production of a uniform chips quality now causes following problems:

tree species vary
the quality of trees varies
the moisture of trees varies
trees are frozen
trees are branchy
the chipping rate of trees varies (depending on the distance of the cutting point from the center of the axis of the disc).

The inventive chipping control device is characterized in that the chipping control device is mounted on the rear surface of the blade disc. When using the chipper, the control device contacts the chips leaving the chipping opening. The inventive disc chipper is characterized in that the control device is fixed to the rear surface of the blade disc. The control device forms together with the initial portion of the wall a concave surface and with which the chips collides when leaving the blade disc.

By means of this invention, said variations in conditions may be observed daily. The control of the chipping occurrence takes best place in connection with replacing the blades, whereby the position of the control device may be transferred, when so needed.

The chips cut from the wood goes over the control device when leaving the blade disc and then collides with the control device at such high a force the pieces of chips still adhered to another break into separate pieces of chips and excessively wide pieces of chips break down.

The control device is used such that the impact against it is not too strong, since a vigorous impact partially breaks down pieces of chips, whereby sticks and sawdust are produced.

Today are used crushing plates and crates for excessively large pieces of chips, against which the chips will fly from the blade disc and crush into pieces. It is also known according to a Finnish patent FI 70171 a chipping-disc crushing system rotating along with the disc chipper and mounted inside a discs opening along with the blade disc. A disadvantage of the chipping crushing device according to the FI patent 70171 is that it may not be controlled and its crushing efficiency has to be selected according to the worst situation. A further disadvantage of the device according to the FI patent 70171 is that it decreases the discs opening in the blade disc.

The invention and its details are described in more detail with reference to the accompanying drawings, in which.

Figure 3A:
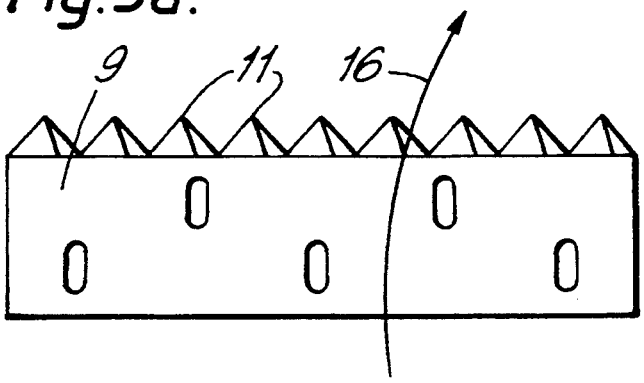
Figure 3C:
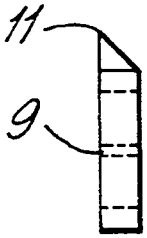
Figure 3B:
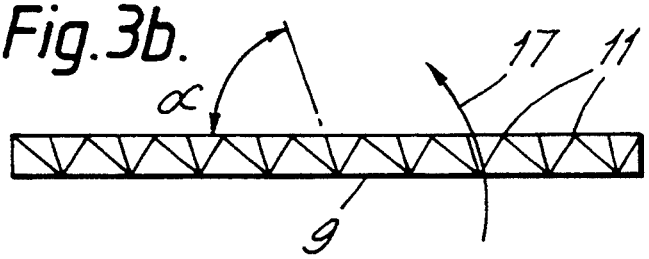
Figure 4A:
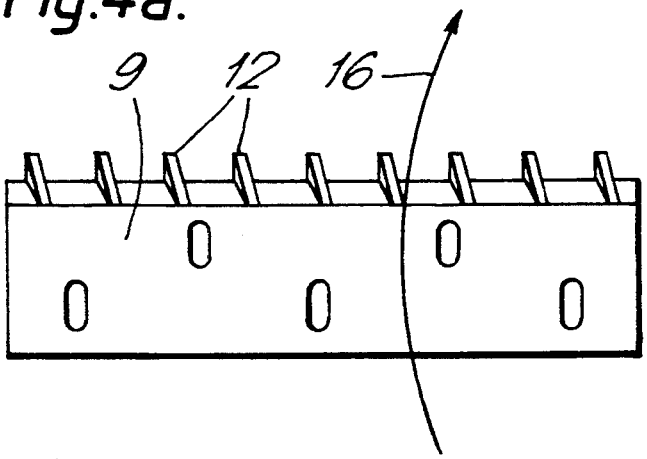
Figure 4C:
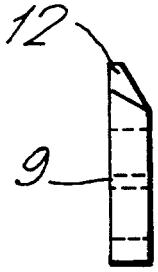
Figure 4B:
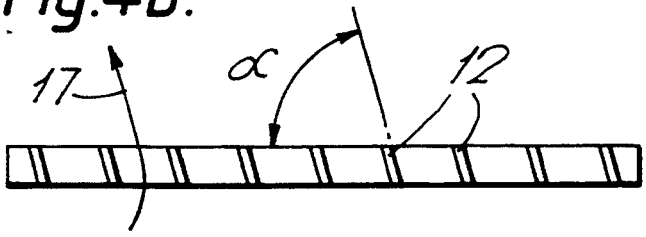
Figure 5:
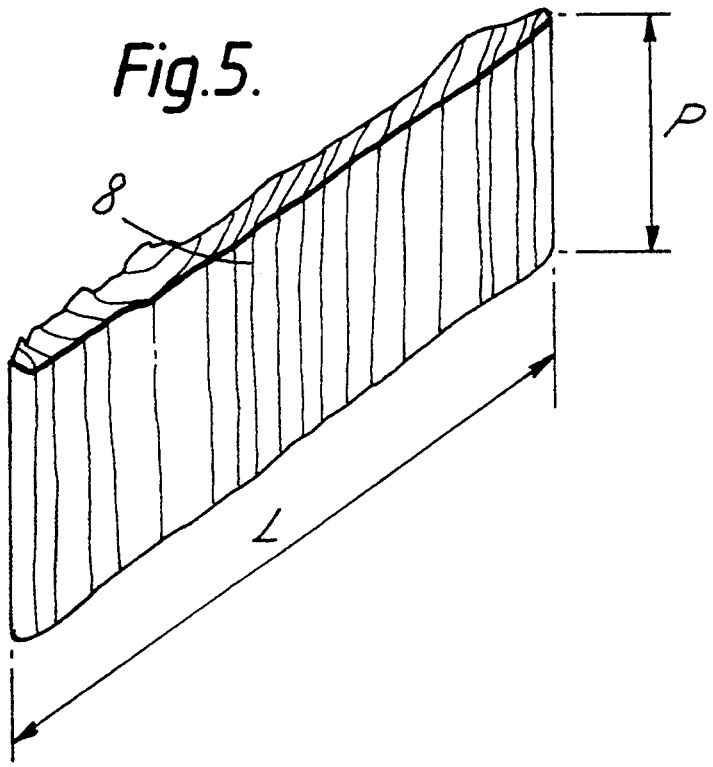
Figure 6:
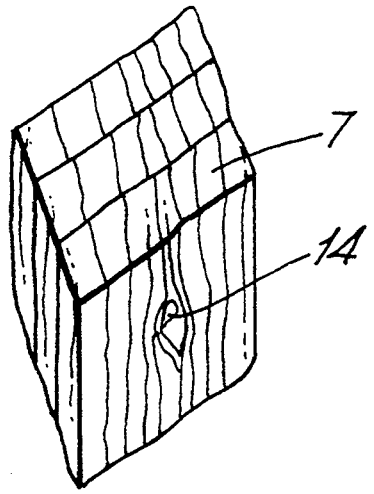
Figure 7A:
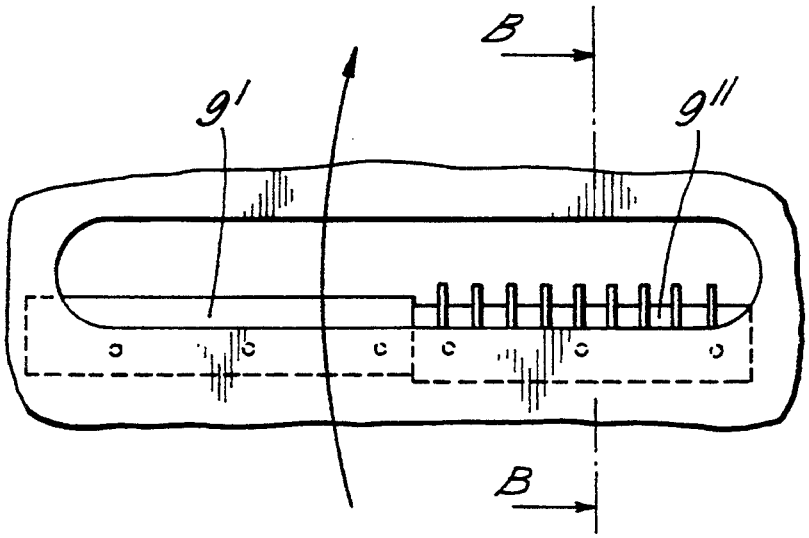
Figure 7B:
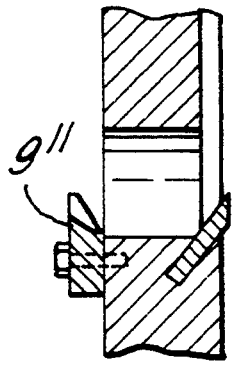

FIG. 3*a*, 3*b* and 3*c* show a certain application on the inventive device seen from three mutually perpendicular directions;

FIG. 4*a*, 4*b* and 4*c* show in a similar manner a certain other application of the inventive control device;

FIG. 5 shows an excessively large piece of chips;

FIG. 6 shows a chips-piece block tied together by a branch;

FIG. 7*a* shows the inventive control device seen from the chips opening of the blade disc and FIG. 7*b* shows a section B—B of FIG. 7*a;*

Figure 8A:
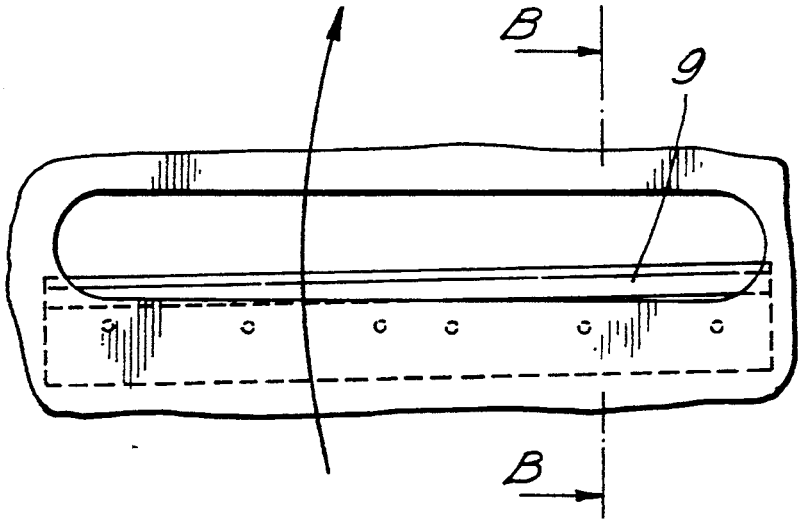
Figure 8B:
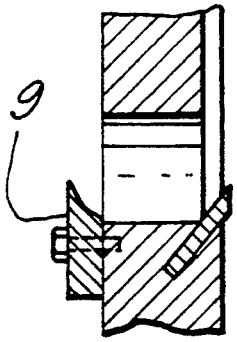
Figure 9:
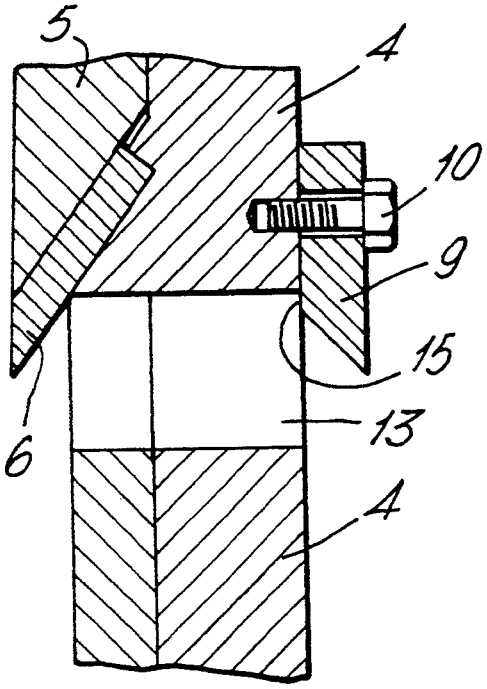
Figure 10:
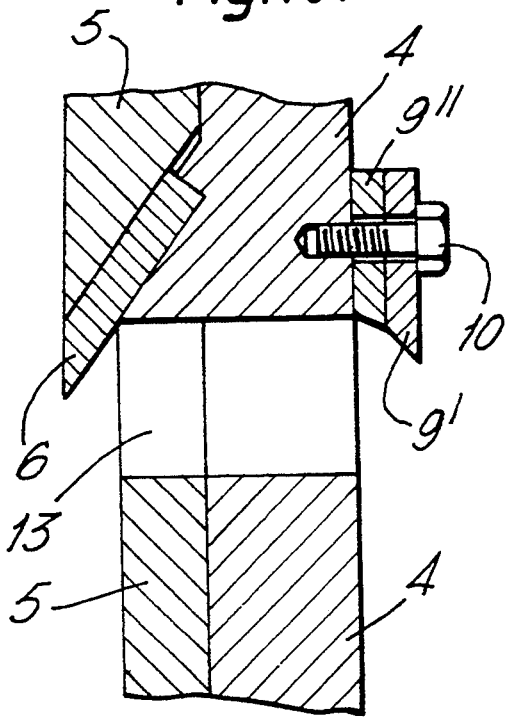
Figure 11:
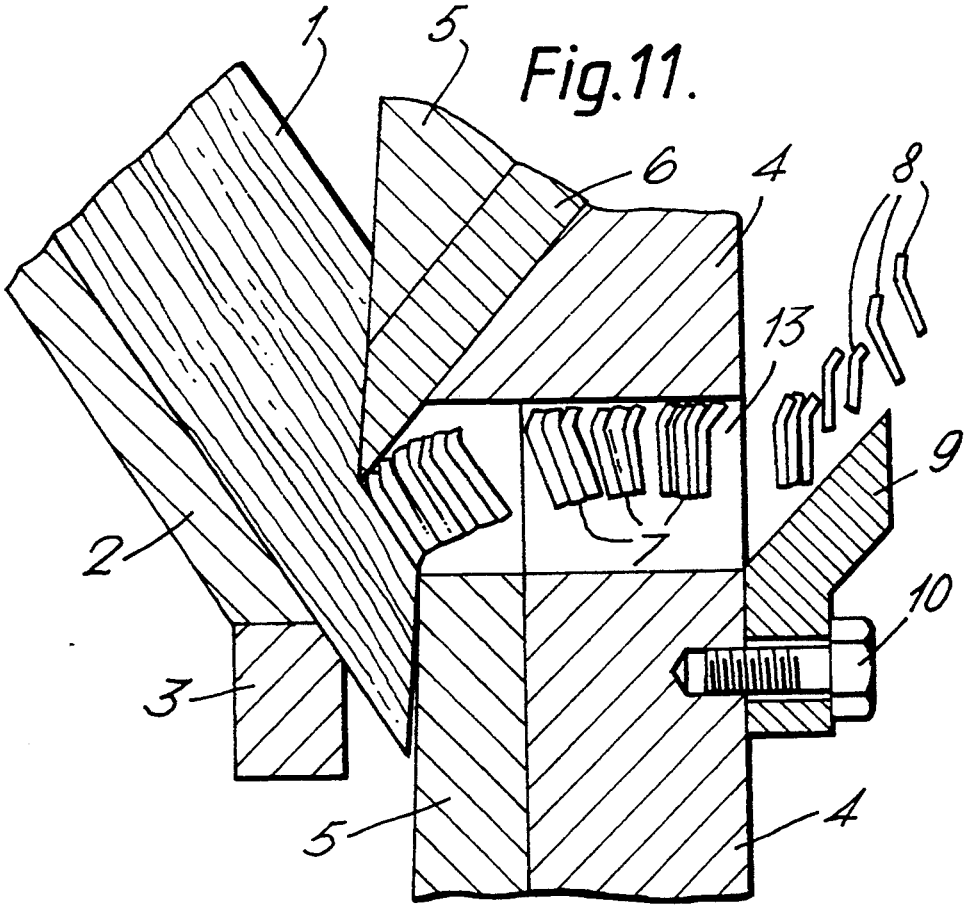

FIG. 8*a* and 8*b* show in a similar manner a certain other application of the invention;

FIG. 9 and 10 further show a detail of two inventive applications as a section in the axial direction of the blade disc; and FIG. 11 shows the chipping control device, which is mounted as an extension for the wall opposite to the blade of the chips opening.

Figure 1:
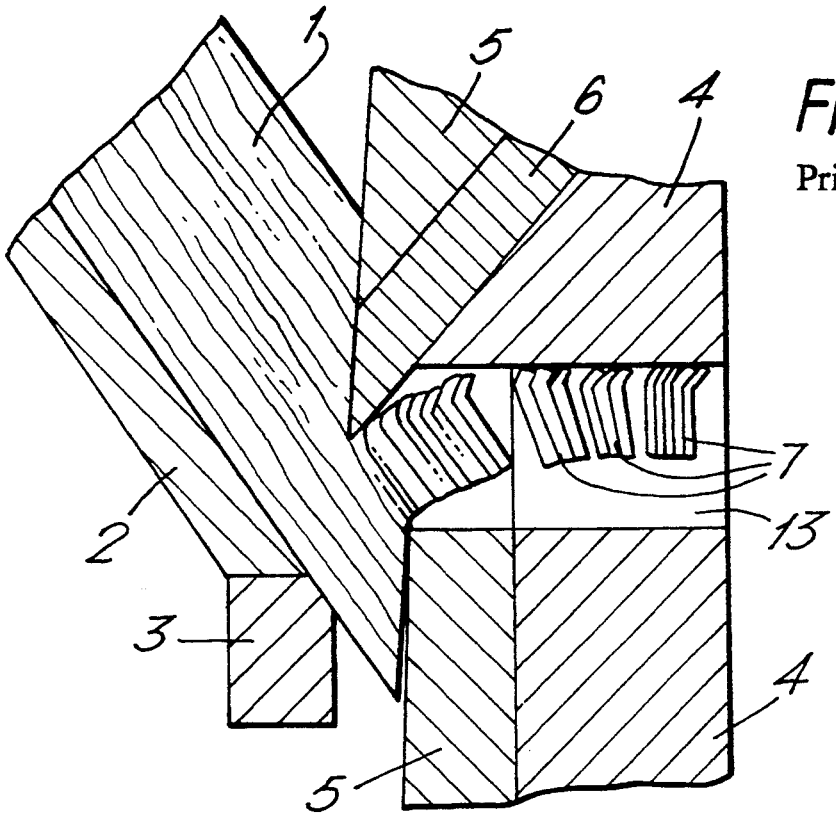
Fig.1. Prior Art
FIG. 1 shows a detail of a prior art disc chipper as a section in the axial direction of the blade disc.

FIG. 1 shows a conventional disc-chipper wood cutting system. The wood 1 to be chipped is fed along a guide wall 2 against a wearing plate 5, which is fixed to a blade disc 4.

The blade 6 cuts from the wood 1 slantingly against a counterblade 4 and the chips leaves via a chips opening 13 on the blade disc 4. When cutting the wood 1, chips-piece discs are produced, which fold agaist the wall of the blade disc 4 and break down into blocks 7. The cuttin occurrence of the wood is in itself such that cracks occur in the chips-piece discs at intervals of 3–5 mm. However, the segments 7 produced by the discs remain coherent by means of some wood fibers or branches. Discs-piece discs often break down into a segment of some discs-pieces according to FIG. 6. Such segments 7 comprised of several discs pieces produce difficulties in the further treatment.

Figure 2:
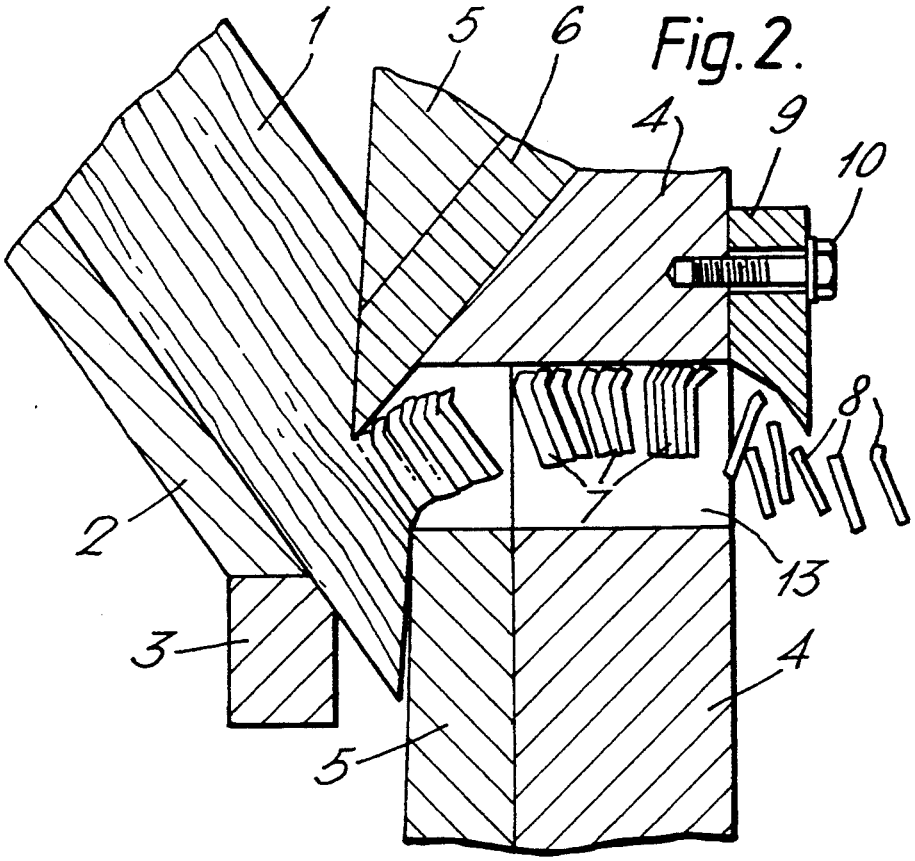
FIG. 2 shows the same detail provided with an inventive control device.

FIG. 2 shows a disc chipper, on which is mounted an inventive chipping control device 9, which is fixed to the blade disc 4 by bolts 10. The control device is a longitudinal list, which is fixed to the blade disc to the outlet side of the discs opening as an extension for the wall of the opening. The cross-section of the edge of the list is designed diagonal such that the outer edge of the list extends to the front of the discs opening, whereby the pieces of discs leaving the chipper collide therewith.

FIG. 3 and 4 show alternatives to the construction of the chipping control device. The control device 9 of FIG. 3 or 4 is especially designed for splitting an excessively wide chips piece 8 of FIG. 5, and a general object is that the width L of a completed chips piece≦its lenght P. Furthermore, the control device 9 has to break down the chips-piece segments 7 of FIG. 6, which are often joined together by a branch 14. On the edge of the control device, which edge extends to the front of the chips opening, the application of FIG. 3 has a "saw blade brush" 11. In the application of FIG. 4, the edge has "rake teeth" 12. A suitable distance between the "saw blade brushes" 11 or the "rake teeth" 12 is 30–60 mm. An arrow 16 indicates in FIG. 3 and 4 the rotational direction of the blade 9. The operation of the chipping control device of FIG. 3 and 4 is best, when the direction of the tip of the ridge of the "saw blade" or "rake teeth" profile is in the travelling direction of the discs 7 and 8. When the discs pieces 7 and 8 are removed from the wood 1 by means of the blade 6, the centrifugal force starts turning the the chips flow according to an arrow 17. A suitable value for an angle $\alpha$ of FIG. 3 and 4 is 60°–75°.

FIG. 7 and 8 show a chipping control device 9 seen from the chips openings of the the blade disc. According to FIG. 7, the control device 9 may be formed from two portions 9′ and 9″, or the control device 9 may be mounted in a slanting position according to FIG. 8. In FIG. 7 and 8, the rotational direction is shown with the arrow 16.

It is commonly known that a low cutting speed on the internal periphery of the disc chipper produces plenty of excessively large discs and discs-piece segments stuck to each other. Therefore, the need for the operation of the control device 9 is much greater near the disc-chipper shaft than on the outer periphery, where the blade has a high cutting speed and the discs leave via the discs opening of the blade disc at a high speed as small pieces. In the aplication of FIG. 7, the portion 9″ of the end on the side of the shaft of the disc is furnished with "rake teeth". In the application of FIG. 8, the control device is thus in a slanting position such that on the end on the side of the shaft its edge extends still further to the front of the chips opening.

When so needed, it is possible to transfer by means of a branchy tree the control device 9 according to FIG. 9 to the front of the chips opening to such an extent that the discs pieces partially collide with a straight surface 15. The chipping control plate 9 may also be comprised of two parts 9′ and 9″ according to FIG. 10, whereby in the cross-section the direction of the slanting wall of the outer portion 9′ deviates from the direction of the wall of the chips opening more than the direction of the slanting wall of the innermost portion 9″.

The chipping control devices shown in FIG. 2, 7, 8, 9 and 10 throw the chipping 8 in the rotational direction of the blade disc. Case by case, the discharge direction occurred may be problematic, and in this case an application of FIG. 11 may be used, whereby the control device 9 forms an extension of the wall of the chips opening opposite to the blade. The extension of the control device 9 of FIG. 11 has to be sufficient such that the chips flow collides therewith.

We claim:

1. A chipping control device for a disc chipper having a blade disc and a chipping blade mounted at a first side of said blade disc and a chips opening extending through said blade disc from the first side to a second side at a position adjacent said chipping blade, said chips opening having a length, said chipping control device comprising:

a longitudinal wall mounted to said second side of said blade disc adjacent said chips opening;

said longitudinal wall being arranged such that chips passing through the chips opening from the first side to the second side collide with the longitudinal wall so as to break the chips into separate pieces; and said longitudinal wall having a length that covers most of the length of the chips opening.

2. A chipping control device according to claim 1, wherein the longitudinal wall is fixed such that its position is readily adjustable with fixing screws and that the longitudinal wall may be mounted slantingly relative to the chips opening.

3. A chipping control device according to claim 1, wherein there are on the edge of a portion of the longitudinal wall to be placed in front of the chips opening of the blade disc extensions spaced apart by a distance.

4. A chipping control device according to claim 3, wherein the direction of the tips of the extensions is parallel to a movement track of the chips leaving the chipping blade extending from a shaft of the blade disc in a travelling direction of the chips.

5. A chipping control device according to claim 1, wherein a portion of the longitudinal wall of the chips opening includes two different profiles.

6. Amended) A chipping control device according to claim 1, wherein the control device is mounted only on a portion on the side of a shaft of the chips opening, whereby it contacts only chips produced at a low cutting speed.

7. A chipping control device according to claim 2, wherein there are on the edge of a portion of the longitudinal wall to be placed in front of the chips opening of the blade disc extensions spaced apart by a distance.

8. A chipping control device according to claim 2, wherein the direction of the tips of the extensions is parallel to a movement track of the chips leaving the chipping blade extending from a shaft of the blade disc in a travelling direction of the chips.

9. A chipping control device according to claim 2, wherein the direction of the tips of the extensions is parallel to a movement track of the chips leaving the chipping blade extending from a shaft of the blade disc in a travelling direction of the chips.

10. A chipping control device according to claim 7, wherein the direction of the tips of the extensions is parallel to a movement track of the chips leaving the chipping blade extending from a shaft of the blade disc in a travelling direction of the chips.

11. A chipping control device according to claim 2, wherein a portion of the longitudinal wall of the chips opening includes two different profiles.

12. A chipping control device according to claim 3, wherein a portion of the longitudinal wall of the chips opening includes two different profiles.

13. A chipping control device according to claim 7, wherein a portion of the longitudinal wall of the chips opening includes two different profiles.

14. A chipping control device according to claim 2, wherein the control device is mounted only on a portion on the side of a shaft of the chips opening, whereby it contacts only chips produced at a low cutting speed.

15. A chipping control device according to claim 3, wherein the control device is mounted only on a portion on the side of a shaft of the chips opening, whereby it contacts only chips produced at a low cutting speed.

16. A chipping control device according to claim 7, wherein the control device is mounted only on a portion on the side of a shaft of the chips opening, whereby it contacts only chips produced at a low cutting speed.

17. A disc chipper, comprising:

a rotatable disc;

a plurality of longitudinal blades on the disc;

a longitudinal chips opening adjacent each longitudinal blade, said chips openings having a discharge opening extending from a front surface of the rotatable disc to a back surface of the rotatable disc;

each of said chips openings including a longitudinal wall; and a control device mounted to said chips opening so as to form a concave surface with the longitudinal wall, so that said chips pieces collide with said concave surface as they exit and break into smaller pieces;

said control device being fixed to the back surface of said rotatable disc.

18. A disc chipper according to claim 17, wherein the control device is connected the wall of the chips opening, adjacent to which the blade is fixed.

19. A disc chipper according to claim 17, wherein the control device is connected to the wall of the chips opening, which is located on an opposite side of the blade.

20. A disc chipper according to claim 17, wherein the control device is removably fixed as an extension of the chips opening and that its position is adjustable.

* * * * *